United States Patent [19]

Smith

[11] 4,104,755

[45] Aug. 8, 1978

[54] VEHICLE FLOOR MAT WASHER

[76] Inventor: Judson L. Smith, 5432 Lighthouse La., Tempe, Ariz. 85283

[21] Appl. No.: 710,630

[22] Filed: Aug. 2, 1976

[51] Int. Cl.[2] ..... B08B 11/00; A46B 13/04

[52] U.S. Cl. ..... 15/40; 15/77

[58] Field of Search ..... 15/40, 77, 21 D, 97 R, 15/100, 102; 134/64 R

[56] References Cited

U.S. PATENT DOCUMENTS

| | | | |
|---|---|---|---|
| 1,208,116 | 12/1916 | Feix | 15/40 X |
| 2,382,089 | 8/1945 | Morgenstern | 15/77 X |
| 2,971,208 | 2/1961 | Moore et al. | 15/77 X |
| 2,986,149 | 5/1961 | Van Brakel | 15/77 X |
| 3,204,271 | 9/1965 | Kingston | 15/40 X |
| 3,333,291 | 8/1967 | Hondzinski | 15/77 X |

FOREIGN PATENT DOCUMENTS

| | | | |
|---|---|---|---|
| 2,404,569 | 8/1974 | Fed. Rep. of Germany | 15/77 |

*Primary Examiner*—Edward L. Roberts

*Attorney, Agent, or Firm*—Woodard, Weikart, Emhardt & Naughton

[57] ABSTRACT

The disclosed mat washer includes a stand with a slot in the top for admission of a floor mat held by an operator who applies a spray of cleaning fluid to the mat from nozzles inside the unit controlled by a foot pedal. The clean mat can be pulled off the top, or permitted to pass through for deposit on a strainer tray. Various arrangements are provided for support of the mat against a rotating brush as the mat is fed down into the slot for scrubbing by the brush.

10 Claims, 11 Drawing Figures

VEHICLE FLOOR MAT WASHER

BACKGROUND OF THE INVENTION

1. Field of the Invention

This invention relates generally to vehicle interior cleaning apparatus, and more particularly to a machine for washing removable floor mats outside the vehicle.

2. Description of the Prior Art

Typical practice at car wash establishments has been to remove the removable floor mats, place them on the floor, and scrub them with sponges or brushes, rinse them, and place them in the car again. Frequently the results are a disorderly working area, inadequate cleaning or rinsing, and replacement of a wet mat in the vehicle.

Two United States patents known to me and representing efforts toward solving the floor mat washing problems are as follows:

| | | |
|---|---|---|
| 3,333,291 | Hondzinski | August 1, 1967 |
| 3,396,422 | Haverberg | August 13, 1968 |

These devices are characterized by fairly significant size and/or complexity. In my opinion, further improvement has been needed in terms of space reduction, cost reduction, and versatility.

SUMMARY OF THE INVENTION

Described briefly, in a typical embodiment of the present invention, a mat washer is provided with an upwardly opening mat receiver area through which a mat is drawn by a scrubbing roll as it is supported by suitable support means and held, if desired, in the hands of the operator. The scrubbing roll means urges the mat against the support means to provide adequate scrubbing action. Cleaning solution applicating means is provided on the scrubbing side of the mat as it moves through the machine, and waste cleaning solution is collectible in a drain trough.

DESCRIPTION OF THE PREFERRED EMBODIMENT

Figure 3:
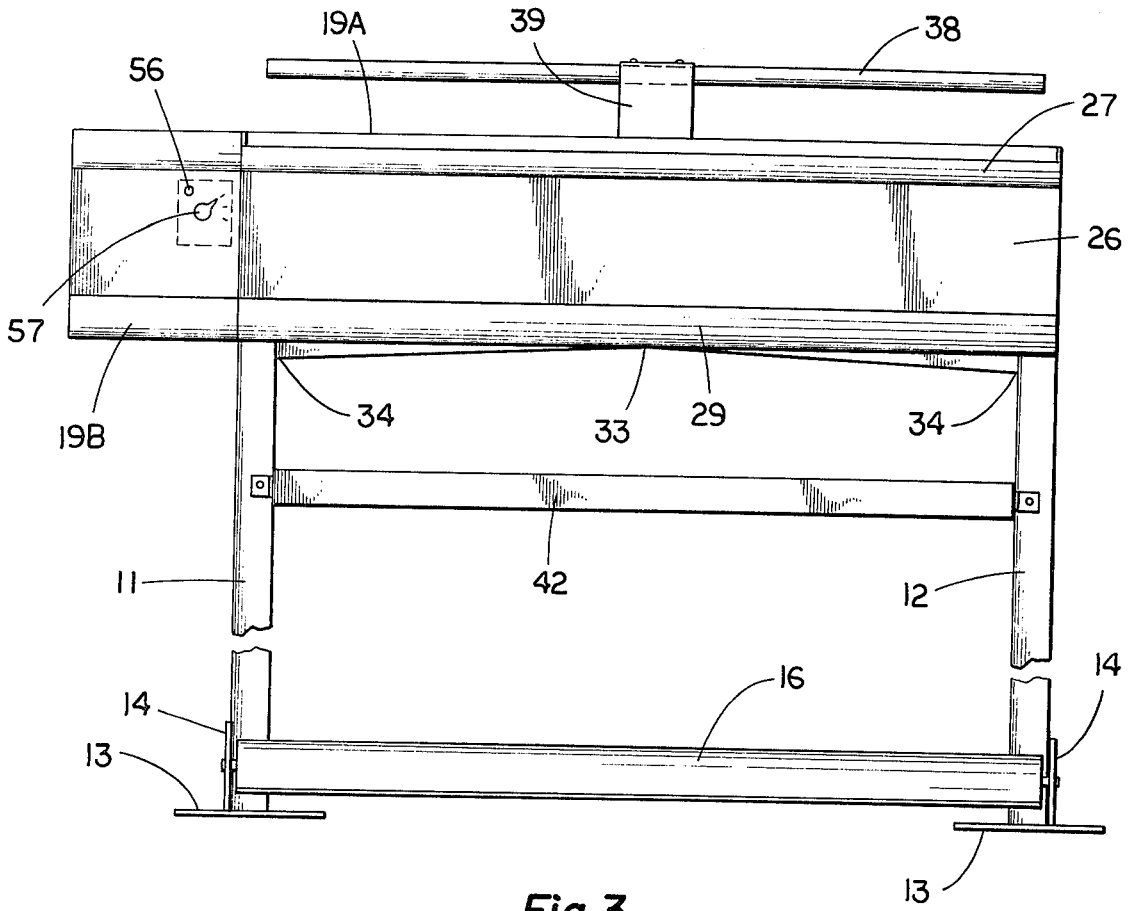
FIG. 3 is a front elevational view thereof.
Figure 5:
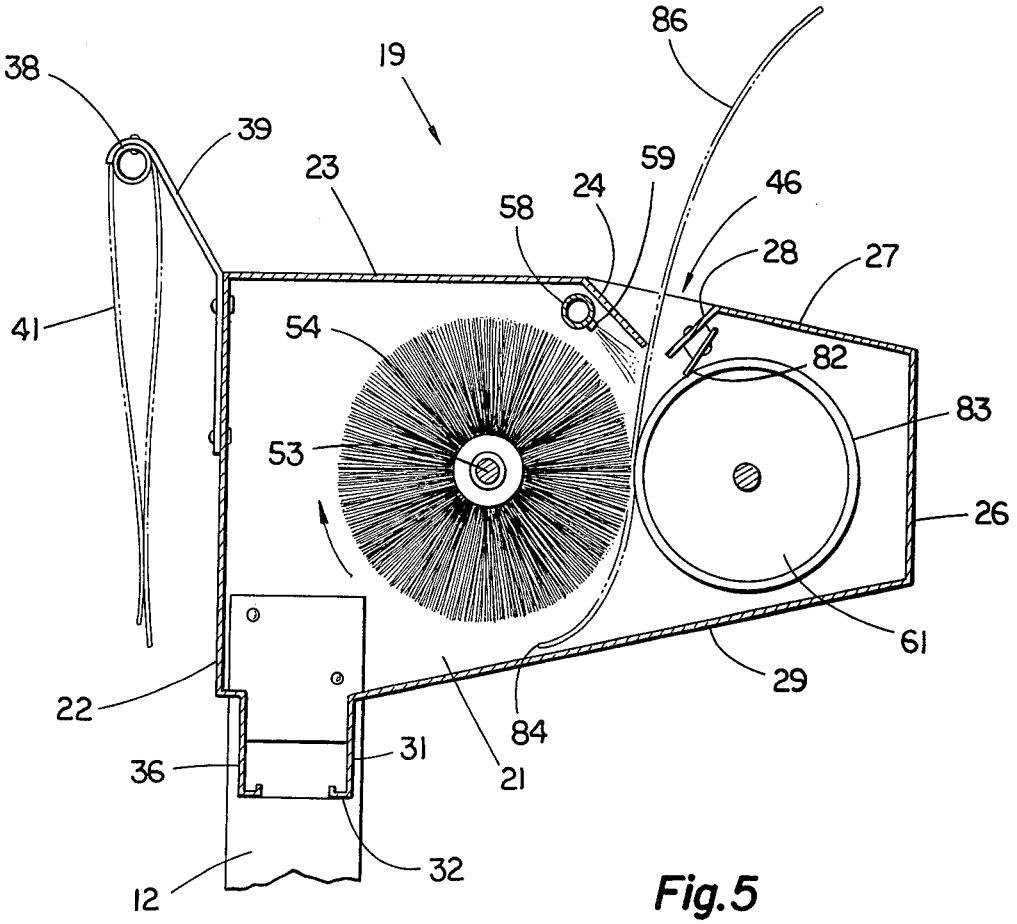
FIG. 5 is an enlarged cross section through the upper portion of the mat washer.

Referring now to the drawings in detail, the stand includes a pair of upstanding support legs 11 and 12 of box section metal welded to feet 13 with suitable gussets 14 secured to the legs and feet and providing bearing apertures 17 for the pivotal mounting of the shafts 18 for the flow control pedal 16. As is best shown in FIG. 5, the legs such as 12 project upward into the upper housing 19 having a side wall 21 riveted or welded to the leg 12. A rear wall is provided at 22 and top wall 23 extending forwardly to a mat entrance guide wall 24. A front wall 26 extends up to the frontal top wall 27 having a mat entrance guide wall 28 at the rear margin thereof. A bottom wall 29 slopes downwardly to the rear from the front wall 26 and has the downwardly projecting wall 31 at its rear end and channel portion 32 at the lower margin thereof. This channel portion extends from a high point near the center of the unit as at 33 in FIG. 3 downwardly and outwardly in the manner exaggerated in FIG. 3 to the points 34 where it enters the box section and can thereby serve as a drain for water depositing on top of the bottom wall 29. The lower portion 36 of the rear wall can be constructed in the same way.

A mat hanger bar 38 is supported at the top of a support plate 39 affixed to the rear wall 22. This serves as a convenient place to store mats such as 41 before or after washing.

A mat drain pan is provided at 42 supported on the posts 11 and 12 and having a mat support grid 43 therein adjacent the top thereof. A drain aperture 44 is provided in the center of the bottom thereof for connection to a hose to provide a drain for any mats placed on the grid for drying.

Figure 1:
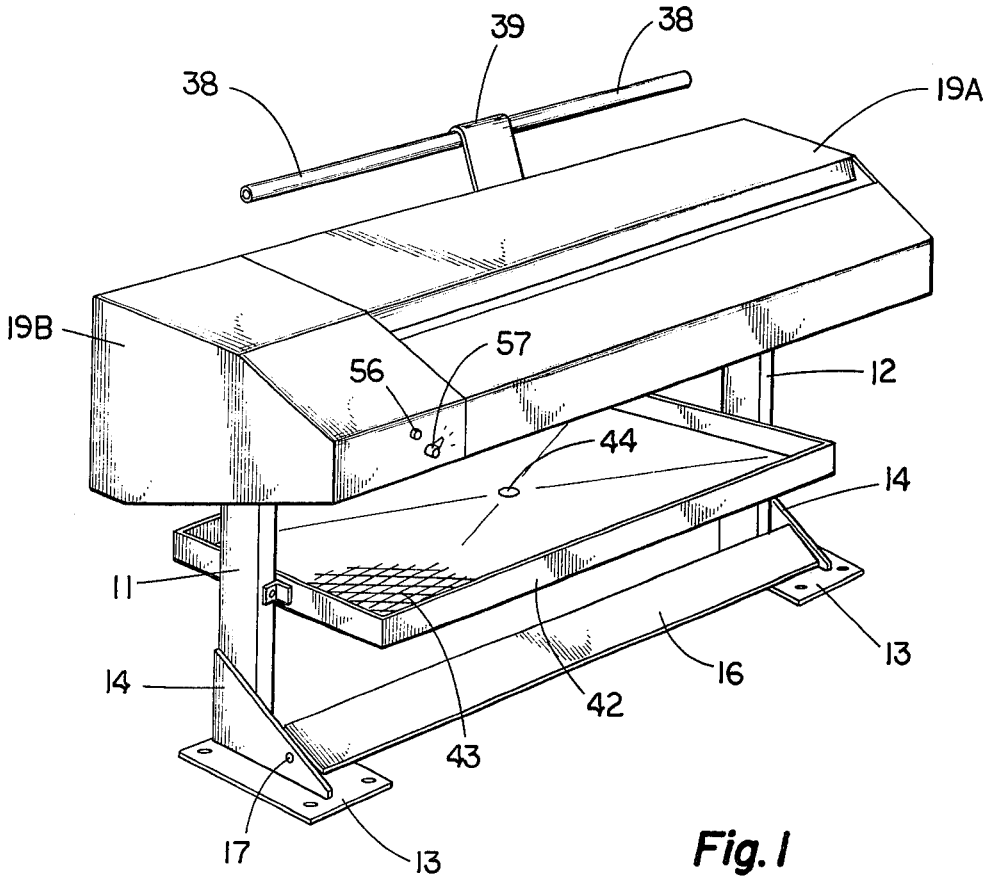
FIG. 1 is a perspective view of a mat washer according to a typical embodiment of the present invention.
Figure 2:
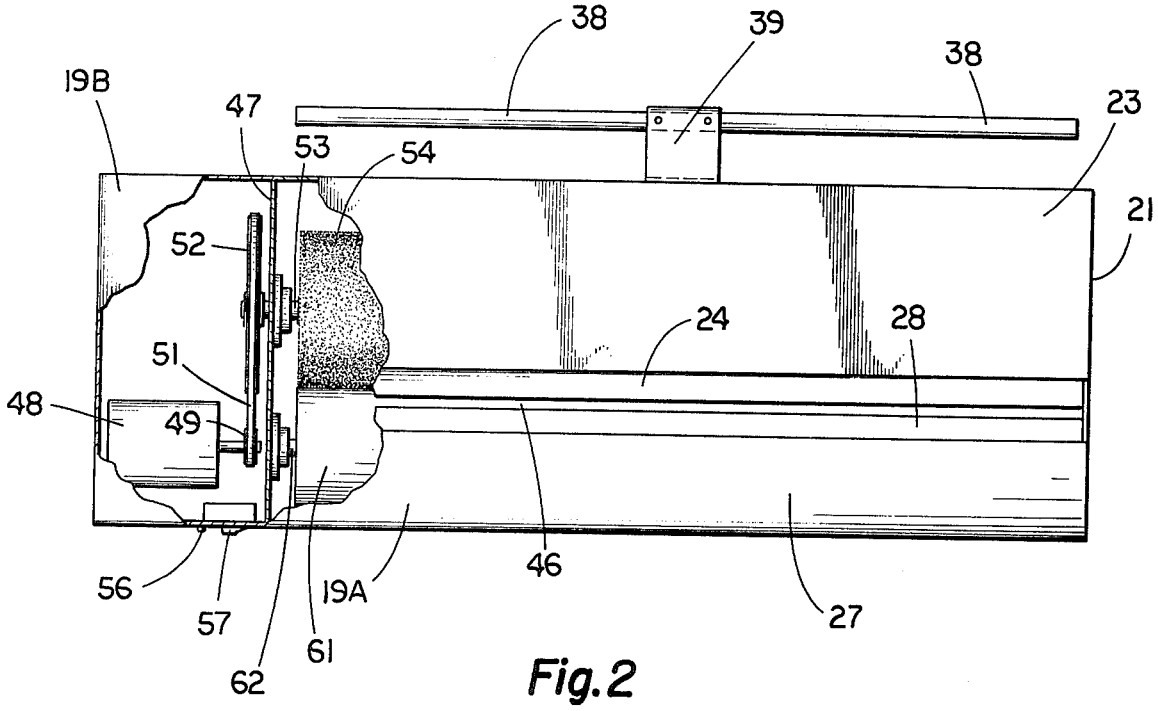
FIG. 2 is a top plan view thereof with a portion broken away to show the motor and brush drive.

Referring further to FIG. 5, the guide walls 24 and 28 define the front and rear margins of a mat entrance slot 46 which extends to the left-hand wall 47 (FIG. 2) of the scrubber housing 19A. A drive housing 19B to the left of this wall contains the drive motor 48, drive pulley 49, belt 51, and driven pulley 52, the latter being connected to the scrub brush mounting shaft 53 to which the scrubber brush 54 is mounted. This brush may be typically an eight-inch diameter brush. Control of the motor is provided by an on-off switch button 56 and speed control knob 57.

Figure 4:
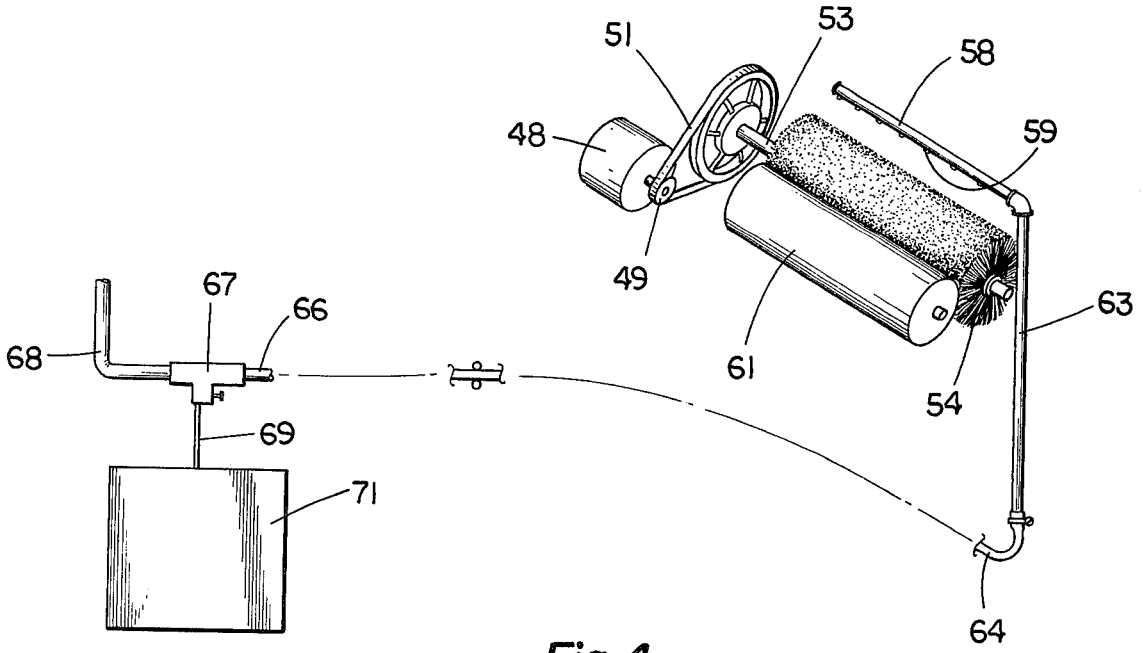
FIG. 4 is a diagrammatic view of the cleaning fluid supply.
Figure 6:
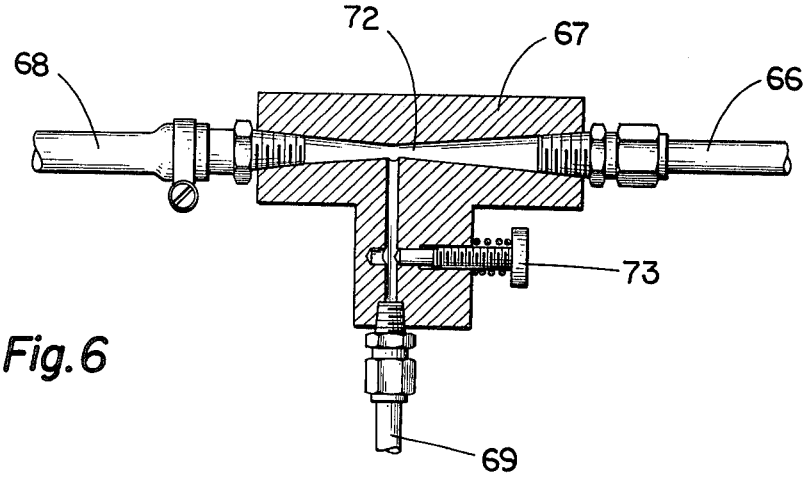
FIG. 6 is an enlarged section through the mixing valve assembly.

A cleaning solution distribution pipe 58 is mounted above the brush and to the rear of the mat entrance guide, and has a plurality of nozzles 59 and spaced along the length thereof and directed toward the mat support roller 61 mounted on a shaft 62 supported in bearings on the walls 21 and 47, respectively. This distribution pipe is supplied by a riser 63 extending upwardly in post 12, for example, and fed from a flexible tube 64 secured to the bottom thereof. This hose 64 is connected to tubing 66 (FIG. 4) connected to the mixing unit 67 supplied with water from a supply pipe 68 and with a cleaning solvent through pipe 69 from reservoir 71. As shown in FIG. 6, there is a venturi 72 in the mixing unit which provides a low pressure point for drawing the solvent up from the tank 71 through the pipe 69 and metering valve 73.

Figure 7:
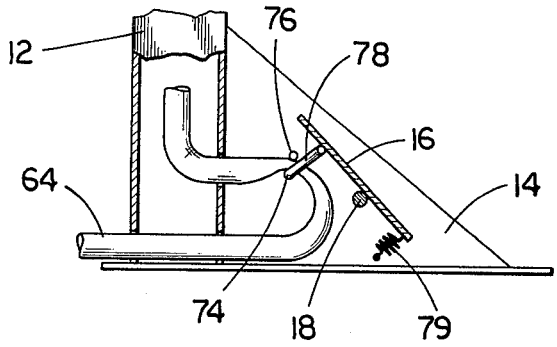
FIG. 7 is an enlarged fragmentary sectional view showing the cleaning solution control pedal and valve.
Figure 8:
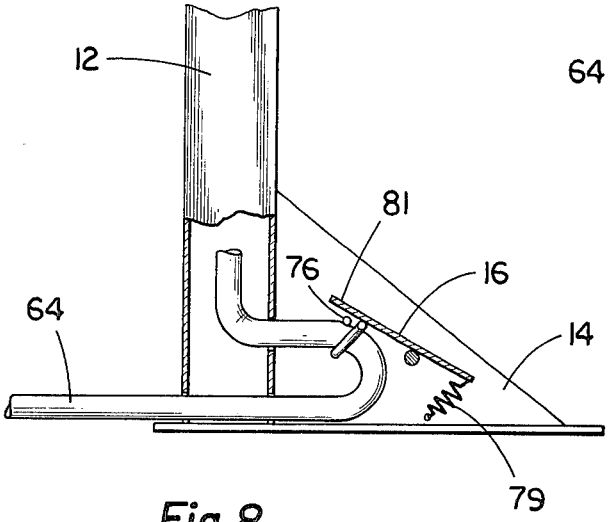
FIG. 8 is a view like FIG. 7 but showing the valve open.

Tube 64 is normally pinched shut as shown in FIG. 7 by means of a horizontally extending bar 74 squeezing the tubing between it and a horizontally extending parallel bar 76, the latter being affixed to the gusset plate 14, and the former being a portion of a Z-shaped rod 78 affixed to the underside of the pedal 16. The pedal 16 is normally retained in the position shown in FIG. 7 by means of the return spring 79 connected to the lower edge of the pedal and to the gusset 14. One such spring can be provided at each end of the pedal. When the forward portion of the pedal at 81 is pushed down by the operator, the bar 74 goes down with it, separating from the parallel bar 76 and thus unpinching the tube so as to permit water solution of cleaner to flow through the tubing to the nozzles from which it is sprayed onto the brush and mat, the amount depending on pedal movement.

A wiper 82 is mounted to the underside of the front guide wall 28 of slot 46 to wipe any moisture from the surface 83 of the support roll 61.

In operation of the unit, the operator admits the lower edge 84 (FIG. 5) of the mat to the slot. The brush engages it and the outer (upper when installed in the automobile) face 86 of the mat begins to be scrubbed. The support roll 61 will turn at the rate that the operator permits the brush to draw the mat into the unit. The lower edge of the mat will then curve forward to the support post as shown in FIG. 5 and will be supported on the bottom 29 of the unit as the operator permits the brush to draw more of the mat into the unit. Eventually the leading edge 84 of the mat will reach the downwardly projecting wall 31 of the bottom of the housing and turn downwardly and pass down in the space between the legs of the unit. If the operator desires to do so, he can permit the mat to fall on the grids 43 of the drying pan. On the other hand, if he does not wish to do that, he can pull the mat upwardly out of the unit. A further possiblity, if desired, is to foreshorten the lower wall 29 of the housing so that the mat passes directly vertically downward between the scrubbing roll and the support roll and descends directly into the pan. In any event, the pan will collect any water/cleaning solution that drips from the mat or from the bottom of the unit.

Figure 9:
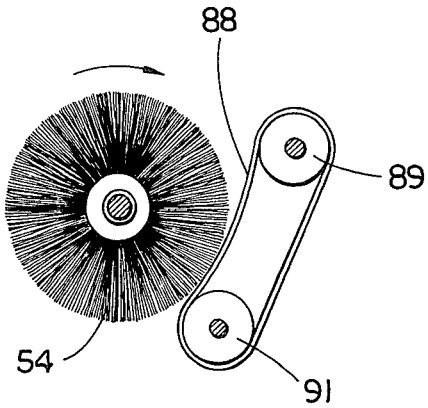
FIG. 9 is a schematic view of another embodiment of brush and mat support.

FIG. 9 shows the alternate embodiment where the mat, instead of being supported by a support roller 61, is supported by a belt 88 mounted between a pair of rollers 89 and 91, both of which would be mounted in the housing 19.

Figure 10:
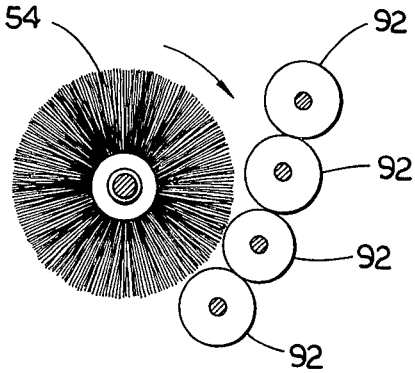
FIG. 10 is a still further embodiment using a contour series of support rollers.

FIG. 10 shows an embodiment in which the mat would be supported by a series of rollers 92.

Figure 11:
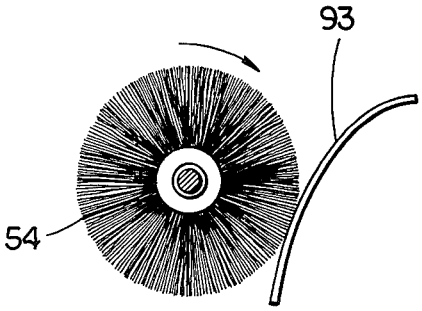
FIG. 11 is a schematic diagram of a still further embodiment using a curved smooth support plate.

FIG. 11 shows the embodiment in which a curved support plate 93 of stainless steel or other material is used to support the mat as it is brushed by the brush 54.

In the embodiment of FIG. 10, rollers can be made of polyvinyl chloride pipe. Other possibilities exist. The preferable material for the curved plate 93 of FIG. 11 is polished stainless steel.

By way of example, the legs are typically 32 inches high, while the overall height of the housing from the upper to lower edge at the rear wall is approximately 10¾ inch. The distance from the front wall 26 to the rear wall 22 is approximately 18 inches. The unit can be made in any desired width, depending upon the size of the mats to be washed and whether or not they are to be placed in the slot lengthwise or crosswise. Because of the fact that the operator is in control of the mat as it is being drawn downwardly through the brushing area by operation of the brush along with gravity, the operator can tip or turn the mat and thereby provide brushing action against the mat in various directions. The fact that the support roll 61 is not driven, enables the operator to pull the mat up out of the washing area if desired, whereupon he can turn it around or turn it over and re-introduce it for brushing in the opposite direction or brushing the opposite side of it. The preferable brush length is approximately 40 inches, and the speed of rotation is preferably 280 revolutions per minute. The bearings for either the brush or support roller can be made positionally adjustable for increasing or decreasing the space between centers of the brush and roller shafts. The wiper or squeegee 82 would be typically made of solid or sponge rubber to squeegee water off the drum. The brush and roller shaft are sufficiently close together that the brush will turn the roller against the resistance of the squeegee when a mat is out.

It was mentioned that the support rollers of FIG. 10 can be made of PVC pipe. The support roll 61 can also be made of PVC pipe, for example. One way is to use PVC "schedule 80" pipe having 6 inch outside diameter O.D., 40 inches long and having two axially spaced internal support discs about 16 inches apart rotatably mounted on a shaft extending parallel to the rotational axis of the brush and affixed to housing walls 21 and 47.

An example of a suitable brush is the model TW2 brush manufactured by the Custom Built Brush Company of Watervliet, Michigan 49098, 40 inches in overall length and eight inches in outside diameter. Such brushes have been used in tire sidewall scrubbers in car wash establishments.

While there have been described above the principles of this invention in connection with specific apparatus, it is to be clearly understood that this description is made by way of example and not as a limitation in the scope of the invention.

What is claimed is:

1. A mat washer comprising:

a housing;

scrubbing roll means and support roll means enclosed in said housing and having substantially horizontal, parallel, and horizontally spaced rotational axes;

said housing having a slot at the top to admit a mat into a work area in said housing between said roll means;

motor drive means coupled to said scrubbing roll means for rotational drive thereof;

cleaning fluid dispenser means enclosed in said housing above said scrubbing roll means for applying cleaning fluid to one face of a mat admitted into said work area;

said scrubbing roll means having work contacting means thereon moving proximate a support surface of said support roll means for contacting said one face and thereby urging a mat disposed between said scrubbing roll means and said support roll means against said support surface to implement scrubbing of the mat by said work contacting means;

said dispenser means include a distribution pipe extending parallel to said axes and having a plurality of spray nozzles spaced along it above said scrubbing hole means and directed toward said support roll means for spraying cleaning liquid onto the scrubbing roll facing face of a mat passing vertically between said roll means;

said housing being constructed to drain continuously from said work area all fluid dispensed and thereby avoid accumulation of fluid around said roll means;

leg means supporting said housing; and dispenser control means including a valve in a liquid conduit between a cleaning liquid source and said dispenser means, and a valve control pedal for operating said valve;

said valve including a flexible walled tube and a pair of cooperating tube-pinching members, one of said members being fixed to said leg means, and the other of said members being fixed to said pedal.

2. The washer of claim 1 wherein:

said leg means include a pair of upstanding floor-mounted leg means supporting said housing at the top of said leg means;

said pedal being pivotally mounted to both of said leg means and extending across the space between said leg means adjacent the lower ends thereof.

3. A mat washer comprising:

a housing;

scrubbing roll means and support roll means enclosed in said housing and having substantially horizontal, parallel, and horizontally spaced rotational axes;

said housing having a slot at the top to admit a mat into a work area in said housing between said roll means;

motor drive means coupled to said scrubbing roll means for rotational drive thereof;

cleaning fluid dispenser means enclosed in said housing above said scrubbing roll means for applying cleaning fluid to one face of a mat admitted into said work area;

said scrubbing roll means having work contacting means thereon moving proximate a support surface of said support roll means for contacting said one face and thereby urging a mat disposed between said scrubbing roll means and said support roll means against said support surface to implement scrubbing of the mat by said work contacting means;

said housing being constructed to drain continuously from said work area all fluid dispensed and thereby avoid accumulation of fluid around said roll means;

said dispenser means including a distribution pipe extending parallel to said axes and having a plurality of spray nozzles spaced along it above said scrubbing roll means and directed toward said support roll means for spraying cleaning liquid onto the scrubbing roll facing face of a mat passing vertically between said roll means;

a cleaning solvent source;

a pressurized cleaning solute source;

and a venturi mixing device connected to said solvent and solute sources to provide a cleaning fluid source.

4. A mat washer comprising:

a housing;

scrubbing roll means and support roll means enclosed in said housing and having substantially horizontal, parallel, and horizontally spaced rotational axes;

said housing having a slot at the top to admit a mat into a work area in said housing between said roll means;

motor drive means coupled to said scrubbing roll means for rotational drive thereof;

cleaning fluid dispenser means enclosed in said housing above said scrubbing roll means for applying cleaning fluid to one face of a mat admitted into said work area;

said scrubbing roll means having work contacting means thereon moving proximate a support surface of said support roll means for contacting said one face and thereby urging a mat disposed between said scrubbing roll means and said support roll means against said support surface to implement scrubbing of the mat by said work contacting means;

said housing being constructed to drain continuously from said work area all fluid dispensed and thereby avoid accumulation of fluid around said roll means;

said scrubbing roll means including a brush having an array of bristles;

said support roll means including a plurality of parallel rollers having their surfaces define a support curve for a mat passing between said brush and said rollers as it is scrubbed by said brush.

5. A mat washer comprising:

a housing;

scrubbing roll means and support roll means enclosed in said housing and having substantially horizontal, parallel, and horizontally spaced rotational axes;

said housing having a slot at the top to admit a mat into a work area in said housing between said roll means;

motor drive means coupled to said scrubbing roll means for rotational drive thereof;

cleaning fluid dispenser means enclosed in said housing above said scrubbing roll means for applying cleaning fluid to one face of a mat admitted into said work area;

said scrubbing roll means having work contacting means thereon moving proximate a support surface of said support roll means for contacting said one face and thereby urging a mat disposed between said scrubbing roll means and said support roll means against said support surface to implement scrubbing of the mat by said work contacting means;

said housing being constructed to drain continuously from said work area all fluid dispensed and thereby avoid accumulation of fluid around said roll means;

said scrubbing roll means including a brush having an array of bristles;

said support roll means including a belt spanning at least two belt support rollers on axes parallel with said scrubbing roll means; whereby said belt provides a support curve for a mat passing between said brush and said rollers as it is scrubbed by said brush.

6. A mat washer comprising:

powered scrubbing roll means mounted for rotation on a horizontal rotational axis;

support means extending parallel to said scrubbing roll means and horizontally spaced from said rotational axis but less than one floor mat thickness away from the periphery of said scrubbing roll means whereby said support means provides lateral support for a mat passed vertically between said support means and said scrubbing roll means as the mat is scrubbed by said scrubbing roll means;

a housing covering at least a portion of said scrubbing roll means and said support means;

means supporting said housing with said scrubbing roll means at a working level;

means for dispensing cleaning fluid in said housing above said scrubbing roll means for wetting said scrubbing roll means and a mat as the mat is moved between the roll means and the support means;

and means for controlling direction of dispensed and used fluid toward drain means; said support means being a curved plate.

7. A mat washer comprising;

powered scrubbing roll menas mounted for rotation on a horizontal rotational axis;

support means extending parallel to said scrubbing roll means and horizontally spaced from said rotational axis but less than one floor mat thickness away from the periphery of said scrubbing roll means whereby said support means provides lateral support for a mat passed vertically between said support means and said scrubbing roll means as the mat is scrubbed by said scrubbing roll means;

a housing covering at least a portion of said scrubbing roll means and said support means;

means supporting said housing with said scrubbing roll means at a working level above the floor;

means for dispensing cleaning fluid in said housing above said scrubbing roll means for wetting said scrubbing roll means and a mat as the mat is moved between the roll means and the support means;

and means for controlling direction of dispensed and used fluid toward drain means;

said support means being a plurality of rollers rotating on parallel axes and providing a generally curved mat support medium.

8. A mat washer comprising:

powered scrubbing roll means mounted for rotation on a horizontal rotational axis;

support means extending parallel to said scrubbing roll means and horizontally spaced from said rotational axis but less than one floor mat thickness away from the periphery of said scrubbing roll means whereby said support means provides lateral support for a mat passed vertically between said support means and said scrubbing roll means as the mat is scrubbed by said scrubbing roll means;

a housing covering at least a portion of said scrubbing roll means and said support means;

means supporting said housing with said scrubbing roll means at a working level;

means for dispensing cleaning fluid in said housing above said scrubbing roll means for wetting said scrubbing roll means and a mat as the mat is moved between the roll means and the support means;

and means for controlling direction of dispensed and used fluid toward drain means;

said support means including an endless belt supported on at least two rollers having axes parallel to the rotational axes of said scrubbing roll means.

9. A mat washer comprising:

a housing;

scrubbing roll means and support roll means enclosed in said housing and having substantially horizontal, parallel, and horizontally spaced rotational axes;

said housing having a slot at the top to admit a mat into a work area in said housing between said roll means;

motor drive means coupled to said scrubbing roll means for rotational drive thereof;

cleaning fluid dispenser means enclosed in said housing above said scrubbing roll means for applying cleaning fluid to one face of a mat admitted into said work area;

said scrubbing roll means having work contacting means thereon moving proximate a support surface of said support roll means for contacting said one face and thereby urging a mat disposed between said scrubbing roll means and said support roll means against said support surface to implement scrubbing of the mat by said work contacting means;

said housing being constructed to drain continuously from said work area all fluid dispensed and thereby avoid accumulation of fluid around said roll means; and a wiper on said support roll means to maintain clean and dry the mat contacting support surface of said support roll means.

10. The mat washer of claim 9 wherein:

said slot is defined by downwardly sloping front and rear mat entrance guide walls converging toward said work area, and said wiper is a squeege mounted to the underside of the mat entrance slot front guide wall, and said dispenser means are mounted under the mat entrance slot rear guide wall.

* * * * *